US005912690A

United States Patent [19]

Endo et al.

[11] Patent Number: 5,912,690

[45] Date of Patent: Jun. 15, 1999

[54] RECORDING MEDIUM TRANSPORTING APPARATUS

[75] Inventors: Noburu Endo; Yutaka Tsunokami, both of Ebina, Japan

[73] Assignee: Fuji Xerox Co., Ltd., Tokyo, Japan

[21] Appl. No.: 08/958,085

[22] Filed: Oct. 27, 1997

[30] Foreign Application Priority Data

Oct. 31, 1996 [JP] Japan ..... 8-305738

[51] Int. Cl.[6] ..... B41J 13/22

[52] U.S. Cl. ..... 347/104; 226/190; 226/193; 400/641; 271/226; 271/268

[58] Field of Search ..... 347/104; 400/641, 400/636; 271/226, 268, 269; 101/420, 421, 422, 423, 424, 425; 420/8; 226/190, 193

[56] References Cited

U.S. PATENT DOCUMENTS 5,560,726 10/1996 Kawaguchi ..... 400/641

FOREIGN PATENT DOCUMENTS

A-5-104798 4/1993 Japan .
A-6-312866 11/1994 Japan .

*Primary Examiner*—Benjamin R. Fuller
*Assistant Examiner*—Christina Annick
*Attorney, Agent, or Firm*—Oliff & Berridge, PLC

[57] ABSTRACT

A recording medium transporting apparatus is shown including a rowel spur. The rowel spur is designed to control the amount of ink adhering to the rowel spur, thus preventing image quality problems associated with slippage between the rowel spur and the recording medium and smudging of ink that is not adhered to the recording medium, as well as maintaining good transporting of the recording medium. The recording medium transporting apparatus transports a sheet shaped recording medium by using a rowel spur. Each tooth of the rowel spur is formed with a plate-like radially inner portion having a substantially constant thickness in a direction parallel to the central axis of the rowel spur, and a wedge-shaped radially outer portion. The wedge-shaped portion includes at least one slanted axial face that intersects a side of the tooth facing in the direction parallel to the central axis. The slanted axial face extends from the substantially constant thickness portion of the tooth to the leading edge of the tooth, thereby defining the wedge-shaped end portion. The remaining thickness of the tooth at the leading edge is 0.04 mm or less (0.01 mm or less is preferable). A material having a Vickers hardness of 500 degrees or above is appropriate for the base material of each tooth of the rowel spur. For example, a heat treated product (SUS631EH) of the stainless steel (SUS631H) is appropriate.

8 Claims, 9 Drawing Sheets

(Stress Test)

(Running Test)

RECORDING MEDIUM TRANSPORTING APPARATUS

BACKGROUND OF THE INVENTION

1. Field of the Invention

The present invention relates to a recording medium transporting apparatus that transports sheet shaped recording medium, and more particularly relates to an improvement of a recording medium transporting apparatus that is provided in a recording medium ejection component of an ink jet recording apparatus or the like. The recording medium transporting apparatus according to a preferred embodiment of the present invention uses a rowel spur, which presses the recording medium and contacts the print surface of the recording medium.

2. Description of Related Art

Conventional recording medium (paper) transporting apparatus use a rowel spur because the ink that is recorded on the normal paper may not be completely dried. The apparatus uses a rowel spur to transport the recording medium by making point contact with the paper and transporting the paper.

This kind of rowel spur reduces the amount of ink adhering to the rowel spur. Retransfer of the ink from the rowel spur to the recording medium, and slippage between the recording medium and the rowel spur or smudging of ink that is not completely adhered to the recording medium are reduced by making the radius of curvature R of the tooth edge of the rowel spur 0.08 mm or less. Japanese Laid-Open Patent Publication No. 5-104798 shows a recording medium transportation apparatus having a rowel spur in which abrasion is decreased by increasing the hardness of the tooth edge by surface processing including plating or the like. Japanese Laid-Open Patent Publication No. 6-312866 suggests that to maintain a high quality image, the radius of curvature R of the tooth edge of the rowel spur should be 0.05 mm or less.

However, when the amount of ink deposited on the recording medium is increased or when the drying of the ink is delayed (slow absorption of the ink into the paper) as a result of a request to make the printed density higher, the amount of ink adhering to the rowel spur cannot be minimized by only reducing the radius of curvature of the conventional tooth edge. Technical problems encountered with conventional apparatus include the retransfer of ink from the rowel spur to the recording medium, the occurrence of slippage between the rowel spur and the recording medium, smudging of ink that is not completely adhered to the recording medium and other image quality problems. Furthermore, when the amount of ink adhering to the rowel spur is increased, the penetration of the leading tooth edge of the rowel spur into the paper is restricted, and the ability of the conventional apparatus to transport the paper is reduced.

SUMMARY OF THE INVENTION

The present invention overcomes the above mentioned technical problems. An object of the present invention is to keep the amount of visible material such as an ink that adheres to the rowel spur to a minimum. A further object is to avoid retransfer of ink adhering to the rowel spur to the recording medium. Yet another object is to avoid image quality problems that result from the occurrence of slippage between the rowel spur and the recording medium and the resultant smudging of ink that is not adhered to the recording medium. Moreover, the present invention provides a recording medium transportation device that is able to constantly perform sufficient transporting of the recording medium by a rowel spur.

BRIEF DESCRIPTION OF THE DRAWINGS

FIG. 1(*b*) is an enlarged perspective view showing a portion of FIG. 1(*a*);

FIG. 3(*b*) is a cross sectional view taken in the direction of arrows B—B in FIG. 3(*a*);

FIG. 3(*c*) is an enlarged view of the portion C circled in FIG. 3(*a*);

FIG. 4(*b*) is a cross sectional view of one tooth in an embodiment of the present invention;

DETAILED DESCRIPTION OF PREFERRED EMBODIMENTS

Hereafter, a detailed explanation of the present invention is given based on the embodiment shown in the attached drawings.

Figure 1B:
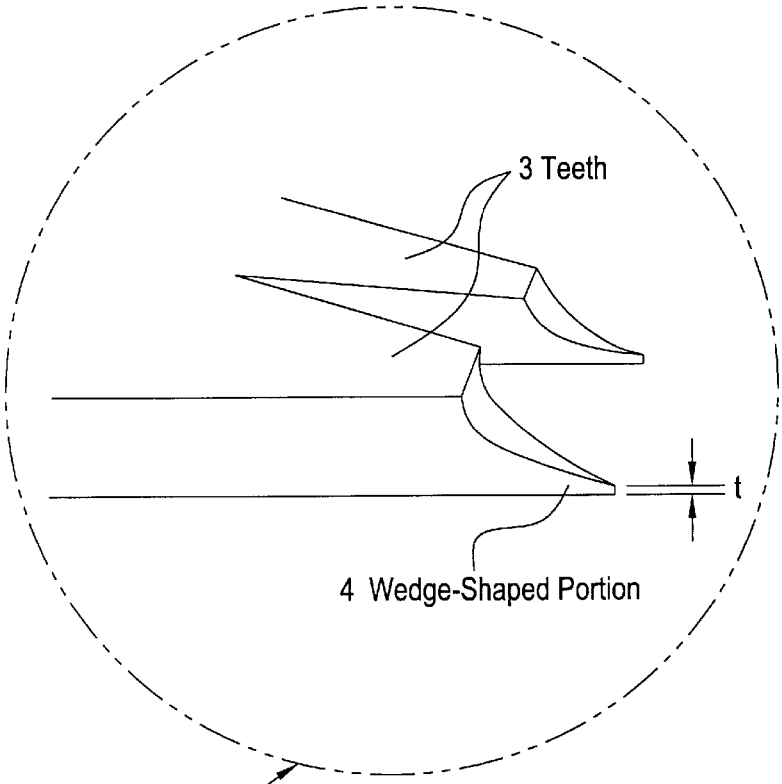
FIG. 1(*a*) is a side elevation view of a recording medium transporting apparatus according to an embodiment of the present invention.
Figure 1A:
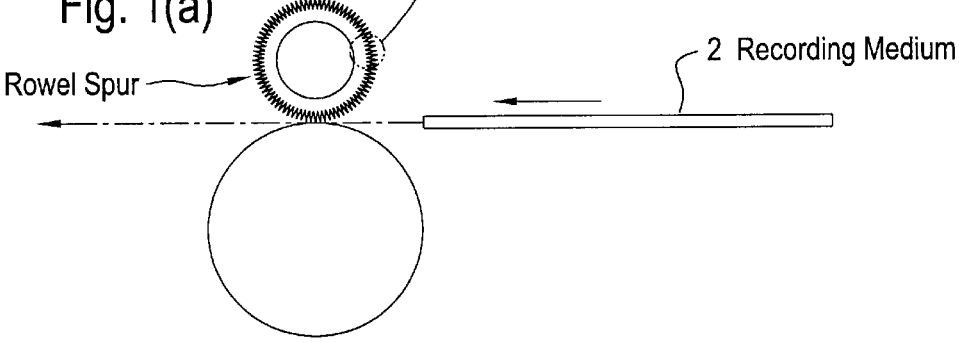

As shown in FIG. 1, a recording medium transporting apparatus according to a preferred embodiment of the present invention transfers a sheet shaped recording medium by using a rowel spur 1. Each tooth 3 of the rowel spur 1 is formed as a plate with a constant thickness in a direction parallel to the central axis of the rowel spur, except for an end section of each tooth extending radially inward toward the central axis of the rowel spur from the leading edge of each tooth 3. This end section extending back from the leading edge of each tooth 3 is formed as a wedge-shaped portion 4.

An apparatus according to the present invention is applicable in any type of technical situation in which a rowel spur 1 is used to transport a recording medium. For example, an apparatus according to the present invention could be provided on the downstream side of the printing component of an ink jet recording apparatus.

The rowel spur 1 includes a core and teeth 3, with the teeth 3 having a plate shape. It is preferable if the core and the teeth 3 are unitarily formed. A resin-made core may be provided in the center portion of metal teeth 3, or both the core and the teeth may be made from metal, with the thickness of the core being different than a thickness of the teeth as viewed in a direction parallel to the central axis of the rowel spur.

Furthermore, one face of the tooth 3 in the wedge-shaped portion 4 on the axial side of the tooth as viewed in a thickness direction parallel to the central axis of the rowel spur may be slanted more toward the leading edge of the tooth than the remainder of that side of the tooth. Alternatively, both faces of tooth 3 in the wedge-shaped portion 4 on both axial sides of the tooth may be slanted more toward the leading edge of the tooth than the remainder of their corresponding sides. The slanted face or faces of tooth 3 in the wedge-shaped portion 4 may be linear or curved.

In particular, the mark made by each tooth 3 on the recording medium 2 (the mark being caused by the retransfer of a visible material such as ink adhered on the rowel spur 1) can be minimized by making at least one face of the wedge-shaped portion 4 concavely curved in the thickness direction of the tooth 3. The concavely curved face (or faces) of the wedge-shaped portion 4 also minimizes the area of penetration of the wedge-shaped portion 4 into the recording medium 2.

Various methods can be used for manufacturing the wedge-shaped portion 4 of the edge of each tooth 3 of the rowel spur 1. However, a preferred simple manufacturing method includes forming the wedge-shaped portion 4 by etching the desired end portion of each tooth. In particular, if isodynamic etching is used, it is possible to make at least one face of the wedge-shaped portion 4 as viewed in an axial direction parallel to the central axis of the rowel spur to be a concavely curved face due to the nature of the isodynamic etching.

Furthermore, the base material for each tooth 3 of the rowel spur 1 can be selected to raise the mechanical strength in order to prevent bending or breaking of the edge of the tooth 3. A base material with Vickers hardness of 500, for example, the heat treated material (SUS631EH) hereinafter, "SUS" is an abbreviation for "Steel, Special, Stainless" and is used in the Japanese Industrial Standard to classify stainless steels in accordance with the numbers following "SUS". For example, "SUS631EH" represents a SUS631H stainless steel which has been heat treated. SUS631H is equivalent to a SUS631 stainless steel as classified by the Japanese Industrial Standard standards. SUS631 is a stainless steel formed by precipitation hardening and is similar to UNS S17700 or AISI SI7700. It includes about 17% Ni, 7% Cr and 1% Al of austenitic stainless steel (SUS631H) is an appropriate base material for each tooth 3 of the rowel spur 1.

Moreover, surface processing may also be performed on the wedge-shaped portion 4 of the leading edge of the tooth 3 to raise the mechanical strength of the leading edge of the tooth 3.

As shown in FIG. 1, each tooth 3 of the rowel spur 1 is formed with a plate shape, having a substantially constant thickness in a direction parallel to the central axis of the rowel spur with the exception of the slanted, wedge-shaped portion at the leading edge of each tooth. A thickness t of the edge of each tooth 3 of the rowel spur 1 is formed at 0.04 mm or less.

In a preferred embodiment, the thickness t of the leading edge of each tooth 3 of the rowel spur 1 is 0.01 mm or less.

With the above-discussed structure, the amount of visible material such as ink or the like adhering to the edge of each tooth 3 of the rowel spur 1 is minimized to the point of being visually undetectable. Moreover, each tooth 3 of the rowel spur 1 bites into the recording medium 2 over a narrow area. Therefore, the retransfer of visible material to the recording medium 2 from each tooth 3 of the rowel spur 1 is very little, and not visible. Since each tooth 3 of the rowel spur 1 bites into the recording medium 2, the pressing force against the recording medium 2 becomes larger and the transporting force is transferred effectively to the recording medium 2.

Figure 2:
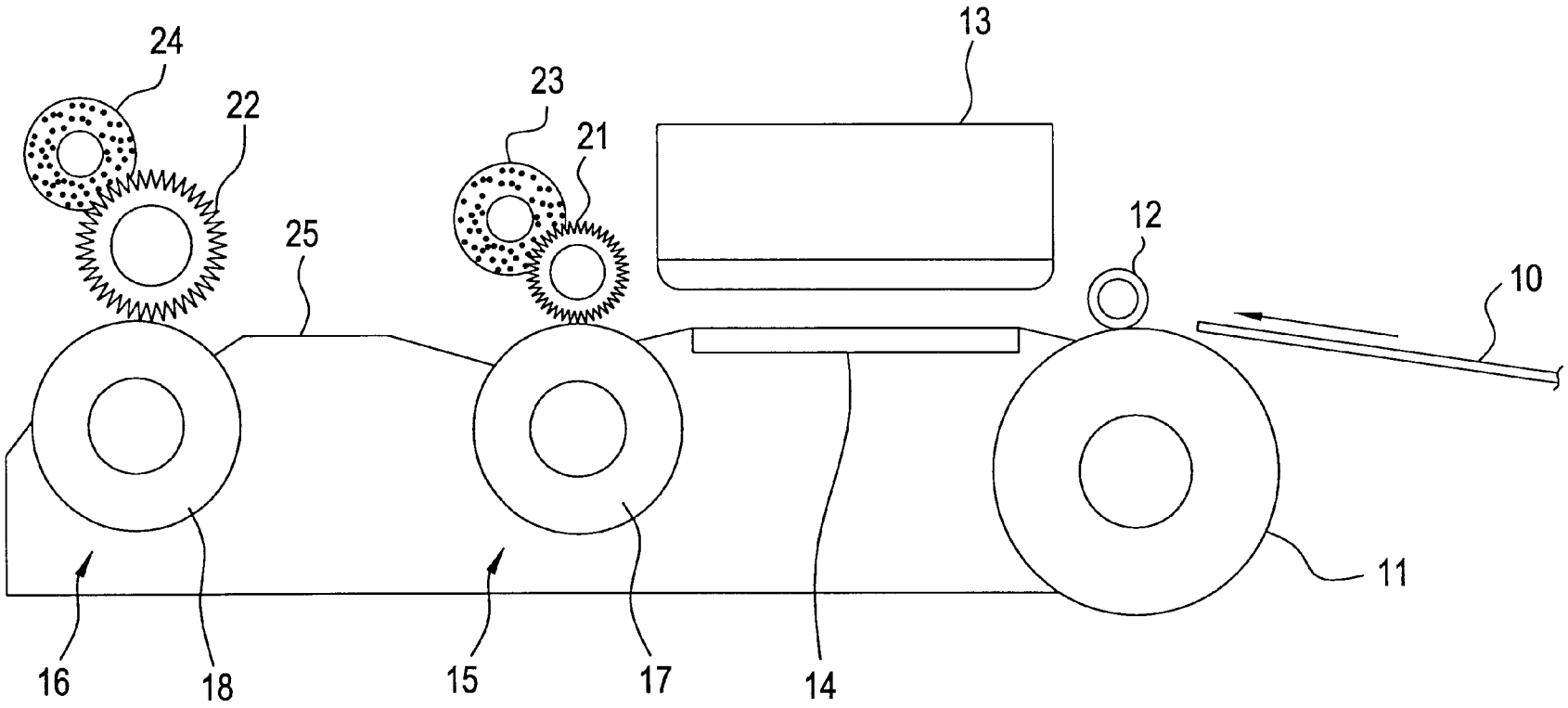
FIG. 2 is a side elevation view of an ink jet recording apparatus in which an embodiment of the recording medium transporting apparatus according to the present invention is provided.

FIG. 2 shows a simplification of the structure of an ink jet recording apparatus including an embodiment of the recording medium (paper) transporting apparatus of this invention. The paper 10 is sent between the print head 13 and the platen 14 by the sending roll 11 and the pinch roll 12, and printed by the print head 13.

Two paper ejection apparatuses (paper transporting or ejecting apparatus) 15 and 16 are arranged at the exit side of the print head 13.

In the embodiment shown in FIG. 2, both paper ejection apparatuses 15 and 16 have ejection paper rolls 17 and 18. The rowel spurs 21 and 22 are arranged in pressing engagement at a specified pressure with the upper side of ejection paper rolls 17 and 18, and rotate in a direction opposite the rotation direction of the ejection paper rolls 17 and 18.

Rowel spur cleaners 23 and 24 are provided in the form of, for example, sponge-made cleaners. These cleaners are arranged in pressing engagement against each of the rowel spurs 21 and 22 for cleaning off the ink adhered to the rowel spurs 21 and 22. A guide 25 is also provided between paper ejection apparatuses 15 and 16 for guiding the paper 10.

Figure 3A:
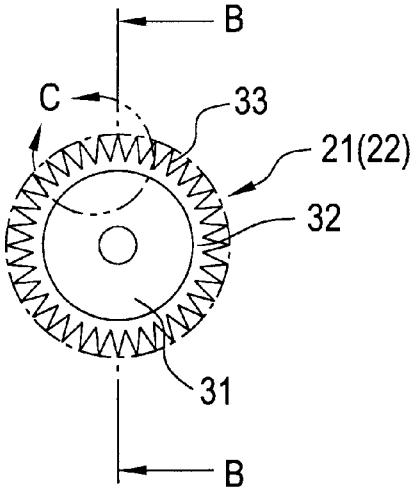
FIG. 3(*a*) is a side elevation view of a rowel spur according to an embodiment of the present invention.
Figure 3B:
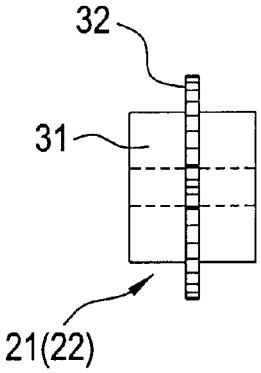
Figure 3C:
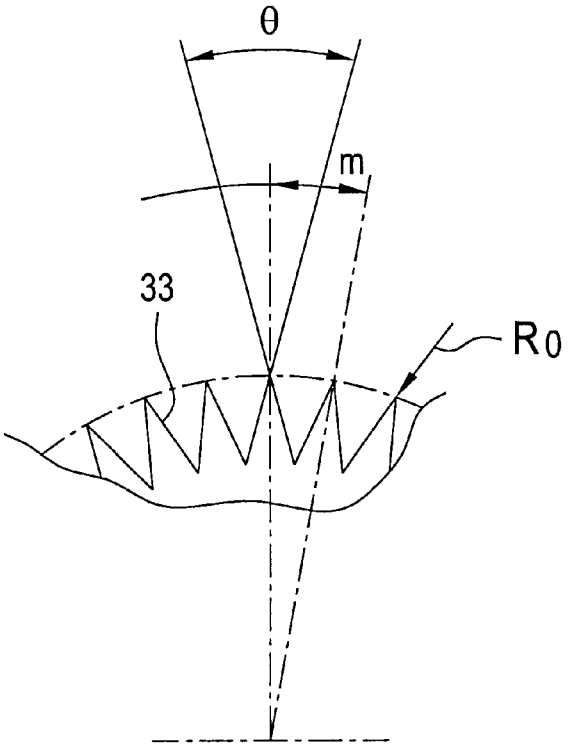

In this embodiment, the rowel spurs 21 and 22, as shown in FIGS. 3(*a*)–(*c*), each include a cylindrical resin-made core 31 that rotates about a central axis (not shown) and an annular metal wheel 32 that is provided around the outer periphery of a center portion of the core 31 and has sharpened teeth 33 formed around the outer periphery of wheel 32. Metal wheel 32 is non-rotatably connected with the resin core 31.

Furthermore, the teeth 33 of the wheel 32, for example as shown in FIG. 3 (*c*), are formed on the outer periphery of the wheel 32 with one tooth every m (10°), for a total of 36 teeth. The teeth are set so that the edge sharpness included angle θ of the leading edge of each tooth 33 is 25° and the radius of curvature $R_0$ of the leading edge portion of each tooth 33 is approximately 0.05 mm.

In the present embodiment, for example, the heat treated material SUS631EH (500HV or more as the Vickers hardness) of the austenitic type stainless steel SUS631H is used for the base material of the wheel 32 of the rowel spurs 21 and 22.

Figure 4A:
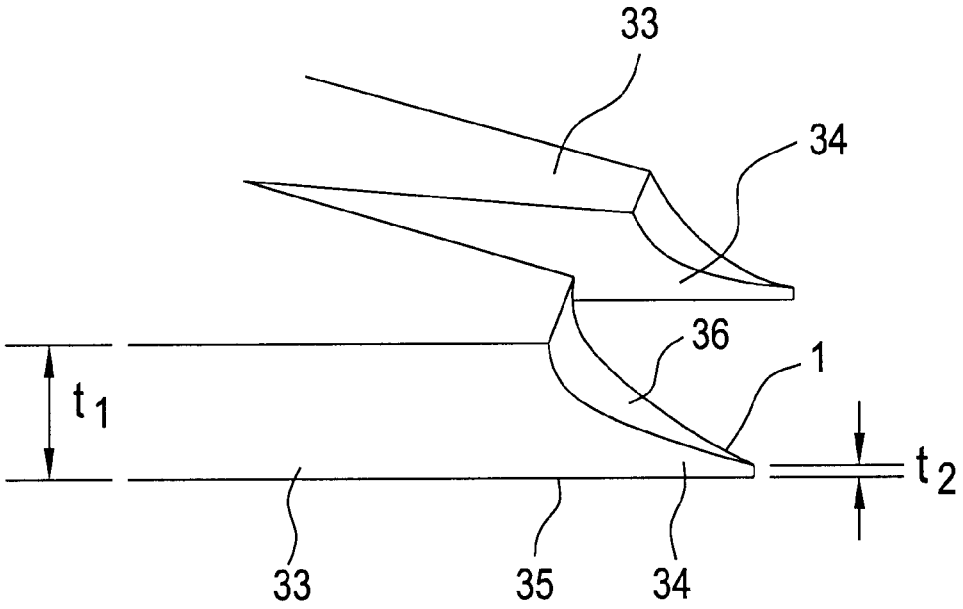
FIG. 4(*a*) is a perspective view showing the details of the edge portions of teeth of the rowel spur according to an embodiment of the present invention.
Figure 4B:
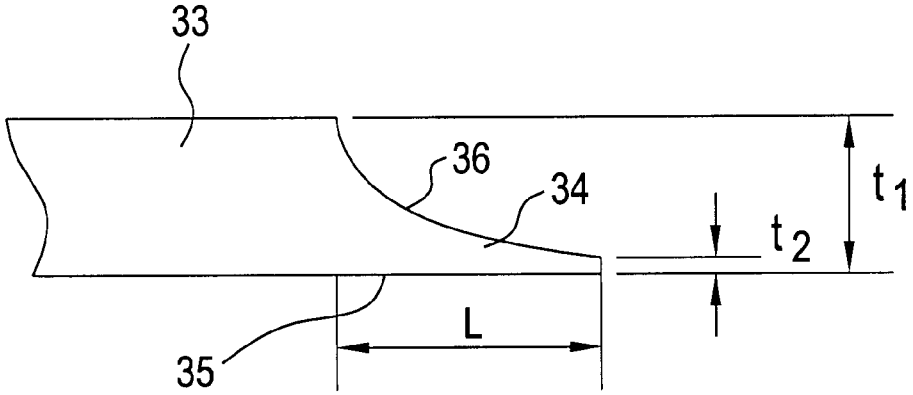

The wheel 32, and therefore each tooth 33 has a thickness of $t_1$ (0.1 mm in the present embodiment). The leading edge of each tooth 33 of the wheel 32, as shown in FIGS. 4(*a*) and 4(*b*), is formed as a wedge-shaped portion 34 that is slanted toward the leading edge across the thickness of the tooth. The bottom axial face of the wheel 32 as viewed in FIG. 4(*b*) of wedge-shaped portion 34 is a substantially flat face 35. A top face of wedge-shaped portion 34 opposite bottom face 35 is slanted face 36. In particular, in the present embodiment, the slanted face 36 is formed as a concavely curved face. The leading edge thickness $t_2$ of the wedge-shaped portion 34 in a direction parallel to the central axis of the rowel spur is 0.04 mm or less, and preferably 0.01 mm or less.

In the present embodiment, the length L of the wedge-shaped portion 34 is determined based on the thickness of the rowel spurs 21 and 22 (in a direction parallel to the central axis of the rowel spur), the thickness $t_2$ of the tooth leading edge and the mechanical strength necessary for the tooth edge. In this embodiment, the length L is set as approximately 0.1 mm.

Next, a method of manufacturing the rowel spur of the present embodiment is explained.

First, the wheel 32 is formed by etching from plate material, using SUS631EH as the wheel 32 base material.

At this point, the wedge-shaped portion 34 extending back a distance L from the leading edge of each tooth 33 of the wheel 32 is processed by isotropic or isodynamic etching in the direction of the thickness of tooth 33. The slanted face 36 of the wedge-shaped portion 34 is naturally formed to have a concave curvature because of the characteristics of isotropic or isodynamic etching.

Then, a hollow portion of the wheel 32 having a diameter equal to the outer diameter of a core 31 is formed by etching. The rowel spurs 21 and 22 are assembled by inserting the resin-made core 31 into the hollow portion of the wheel 32 such that core 31 and wheel 32 form a unit with wheel 32 non-rotatably connected to core 31.

Figure 5:
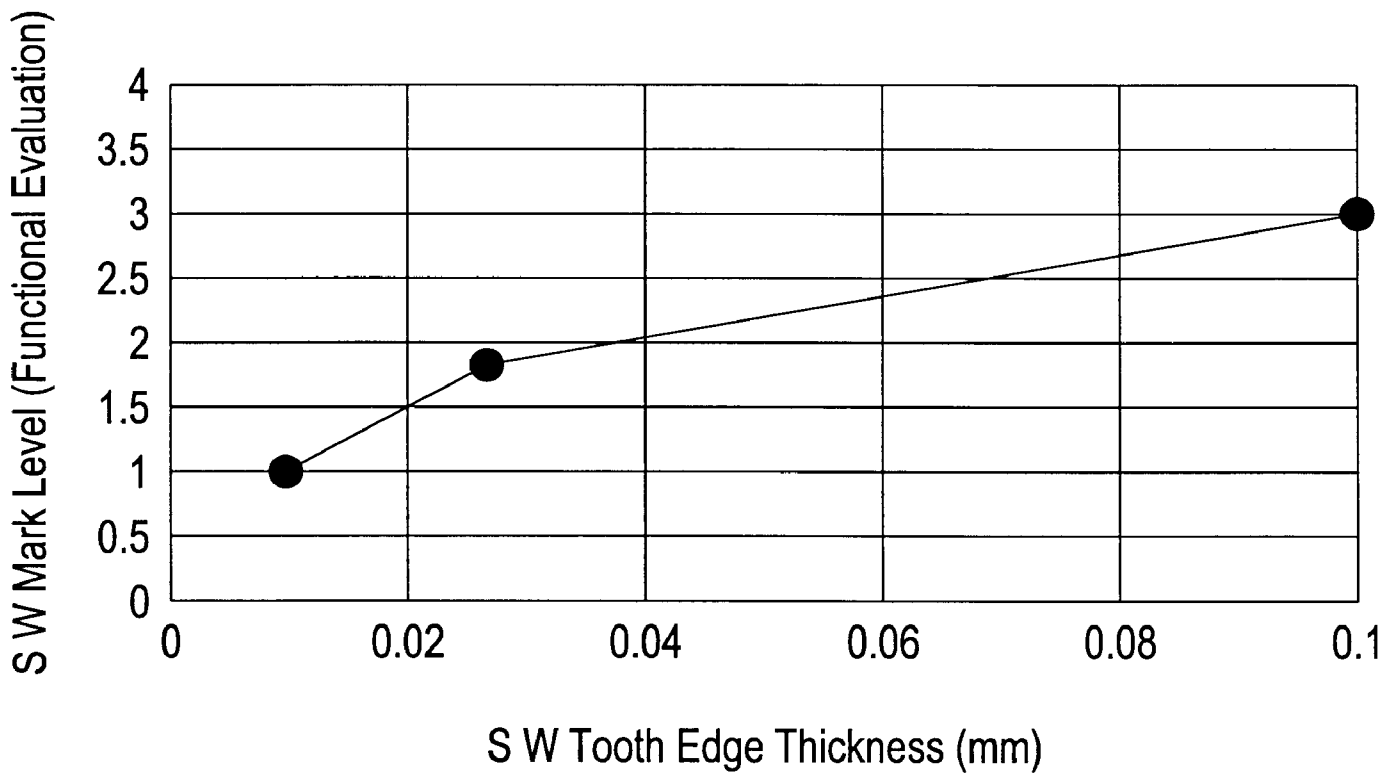
FIG. 5 is a graph showing the relationship between the tooth edge thickness of the rowel spur and the rowel spur mark level in a first embodiment of the present invention.
Figure 9:
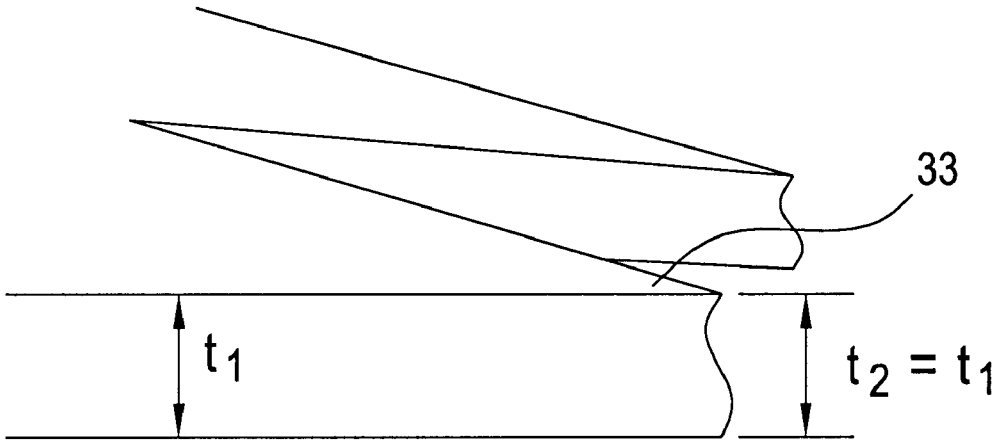
FIG. 9 is a perspective view showing the edge portion structure of the rowel spur of a comparison embodiment.

Next, the relationship between the tooth leading edge thickness of the rowel spur of the present embodiment and the rowel spur mark (SW mark) level (a mark level when the ink which is adhered to the rowel spur is re-transferred to the paper) is indicated in FIG. 5. As an experimental parameter, the force with which the rowel spurs 21 and 22 are pressed against recording medium 10 is 10 gf. As a comparison embodiment, as shown in FIG. 9, the thickness $t_2$ of the leading edge of the tooth 33 of the rowel spurs 21 and 22 is the same as the overall thickness of the tooth $t_1$.

As for the evaluation in FIG. 5, we used a functional evaluation with 5 grades. The preferred rowel spur mark level is a grade 2 or less.

In the comparison embodiment, the rowel spur mark level is grade 3. For the rowel spur of a preferred embodiment of the present invention, when $t_2$ is 0.04 mm or less, the rowel spur mark level is grade 2 or less. Therefore, the rowel spur mark level satisfies the desired tolerance. In particular, it is confirmed that when $t_2$ is 0.01 mm or less, the rowel spur mark level becomes grade 1 or less, which is very favorable.

Concerning these results, it is thought that in the comparison embodiment, the contact area between the paper and the tooth edge of the rowel spur becomes large, and as a result, the amount of ink which adheres on the tooth edge increases. In contrast, in the preferred embodiment such as shown in FIGS. 1, 4(*a*) and 4(*b*), the contact area between the paper and the tooth edge of the rowel spur is small. As a result, the amount of ink which adheres to the tooth edge substantially decreases.

Next, in the present embodiment, we experimentally confirmed that SUS631EH (the heat treated material of SUS631H) is appropriate as a wheel 32 base material.

As for the experimentation method, we made rowel spurs using several kinds of wheel base materials (SUS304H, SUS301EH, SUS631H, SUS631EH). We executed stress tests by putting the appropriate number (for example 3 wheels/108 teeth—with only 75 teeth being observable) of the rowel spurs in a plastic bag, then shaking them in both vertical and horizontal directions several times (for example, 10 times), and lightly squeezing them 5 times by hand.

We carried out a running test by making rowel spurs using several kinds of the wheel base materials (SUS304H, SUS301EH, SUS631H, SUS631EH), and installing the rowel spurs into the actual machine, then actually passing a paper for 10 KPV.

Figure 6:
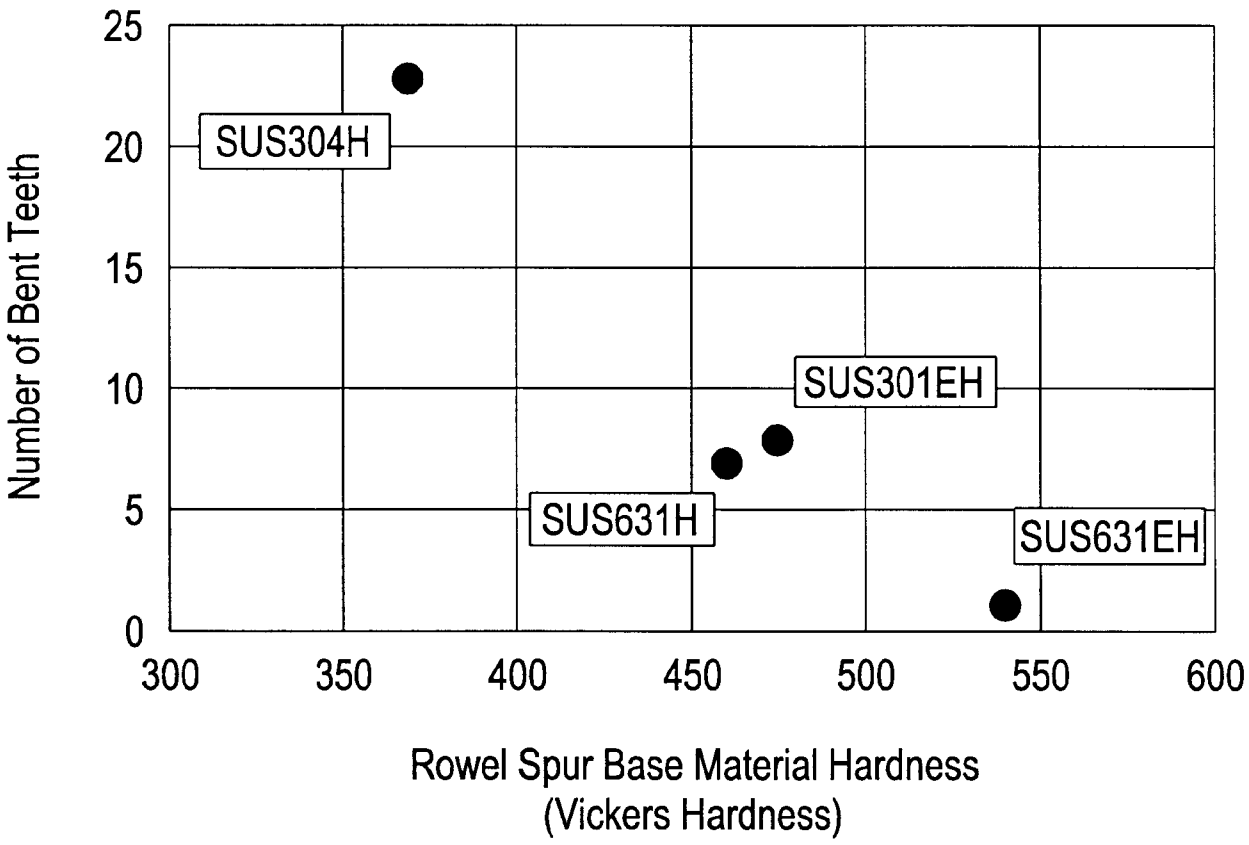
FIG. 6 is a graph showing the relationship between the tooth base material hardness and the mechanical strength (the frequency of bending of the tooth edge) of the tooth edge of the rowel spur of the first embodiment.
Figure 7:
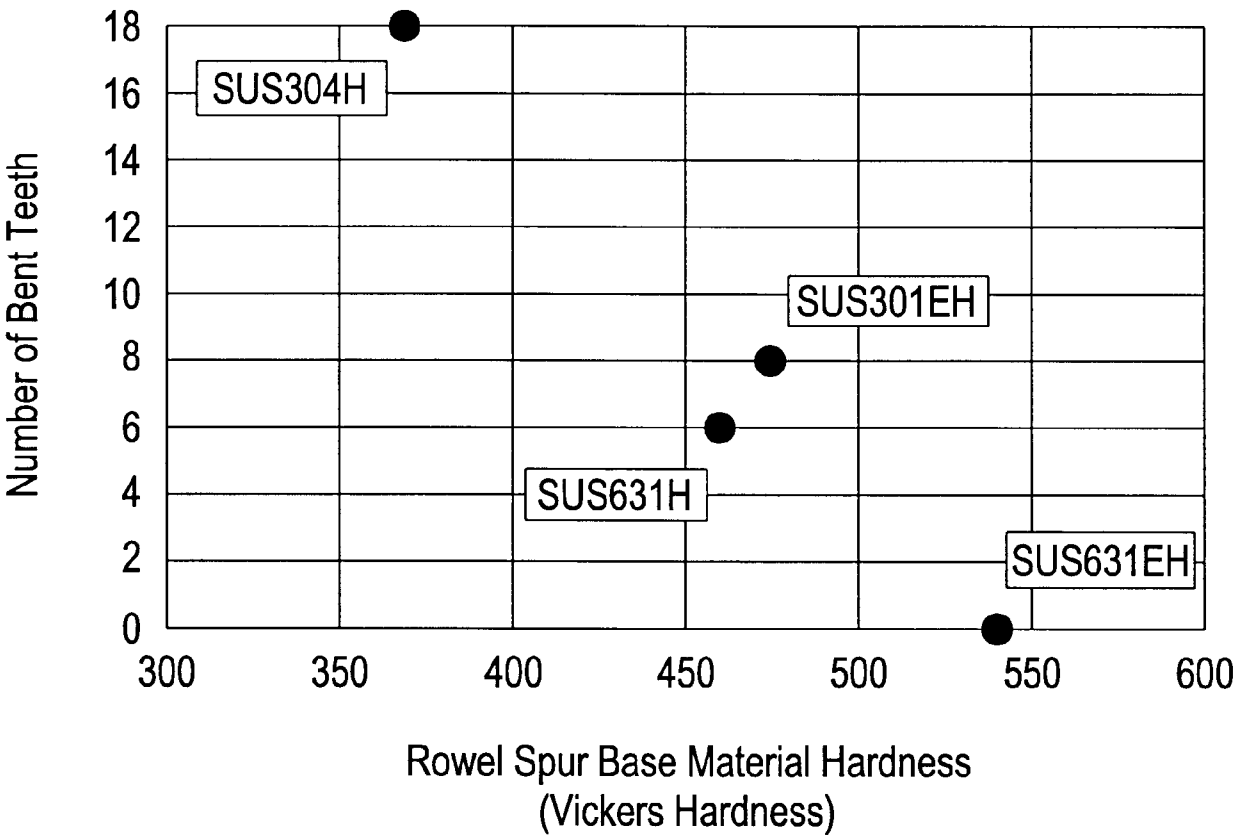
FIG. 7 is a graph showing the relationship between the tooth base material hardness of the rowel spur and the mechanical strength of the tooth edge of the rowel spur based on the result of a running test which performs a 10 kPV pass of recording medium by the rowel spur of the first embodiment.

The frequency at which the tooth edges of the rowel spurs were bent after executing these kinds of stress tests and the running test is shown in FIGS. 6 and 7. The results shown in FIGS. 6 and 7 are summarized in Table 1 below:

TABLE 1

| Base Material | Vickers Hardness | Frequency of Edge Bending During Stress Test | Frequency of Edge Bending During Running Test | Evaluation |
|---|---|---|---|---|
| SUS304H | 370 | 23/75 | 18/42 | X |
| SUS301EH | 420~530 | 8/75 | 8/42 | Δ |
| SUS631H | 460 | 7/75 | 6/42 | Δ |
| SUS631EH | 530~550 | 1/75 | 0/42 | ○ |

As shown in Table 1, an austenitic type stainless steel such as SUS631EH (the heat treated material of the SUS631H) is appropriate for the wheel base material.

The tooth edges of a rowel spur made from SUS304H, SUS301EH and SUS631H are bent during the running tests. As a result, the amount of ink adhering to the rowel spur is increased, and the ink retransfer problem occurs.

In contrast, for a rowel spur in which an austenitic stainless steel such as SUS631EH is used, we confirmed that the mechanical strength of the tooth edge of the rowel spur is increased. Therefore, even when the thickness of the tooth edge of the rowel spur is 0.01 mm or less, problems such as bending, breaking or abrasion of the tooth edge at the time of the paper transportation do not occur, and a high quality image can be obtained.

Next, the relationship between the design of the rowel spur and the ink drop amount is examined. The ink drop amount is the mass of ink deposited per unit area of the recording medium. As for the experimentation method, the ink drop amount used with the rowel spur according to a preferred embodiment of the present invention ($t_2$=0.01 mm) is increased from approximately 9.0 mg/inch$^2$ to 10.1 mg/inch$^2$, and the rowel spur mark (SW mark) level is functionally evaluated. Further, in the present examination, the force with which the rowel spurs 21 and 22 are pressed against the recording medium is 10 gf.

Figure 8:
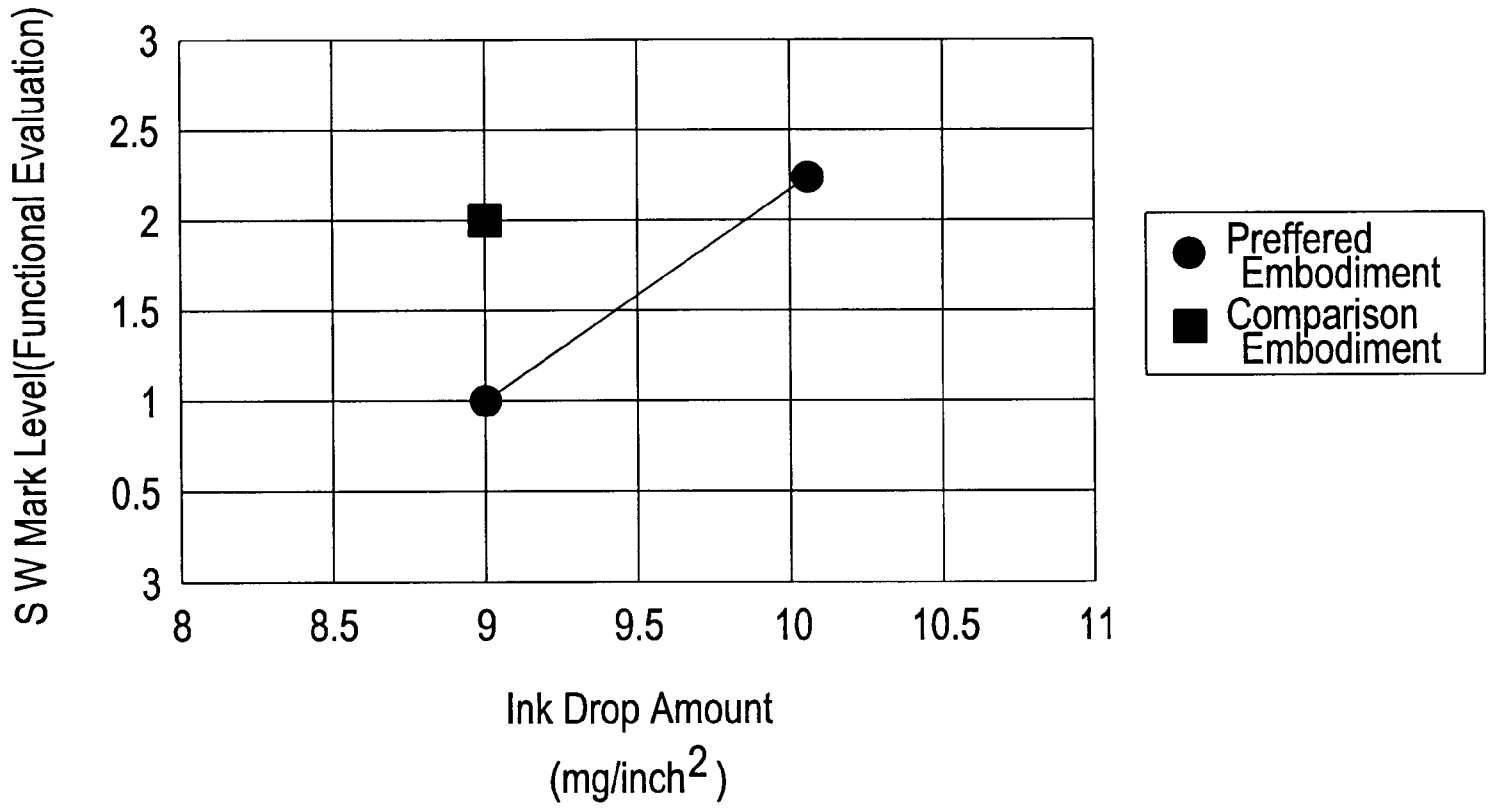
FIG. 8 is a graph showing the relationship between the ink drop amount and the rowel spur mark level for the rowel spur of the first embodiment.

The result is indicated in FIG. 8.

According to the same figure, it is confirmed that when the ink drop amount increases from 9.0 mg/inch$^2$ to 10.1 g/inch$^2$, the rowel spur mark (SW mark) level deteriorates from grade 1 to grade 2 or 3 (indicating an increased amount of ink adhering to the rowel spur and being retransferred to the recording medium).

At this point, if the rowel spur mark (SW mark) level is grade 2 and is within the desired tolerance range, it is confirmed that in the present embodiment, the rowel spur is acceptable even if the ink drop amount is increased up to approximately 9.8 mg/inch$^2$. It can be seen that this is superior to the comparison embodiment (refer to FIG. 9) in which the ink drop amount can only be increased to 9.0 mg/inch$^2$.

Furthermore, the quantity of rowel spurs necessary to achieve a grade 2 for the rowel spur mark level is investigated by using the rowel spur of the present embodiment.

If the necessary transporting energy to transfer A4 Vertical size 210 mm paper is 100 gf, the pressing force (with no rowel spur cleaner) that can be applied to the rowel spur while still maintaining a grade 2 rowel spur mark level is approximately 11 gf for one rowel spur ($t_2$ 0.01 mm) in the preferred embodiment (refer to FIGS. 4(*a*) and 4(*b*)). In contrast, in the comparison embodiment of FIG. 9, pressing force of the rowel spur is limited to approximately 5 gf while maintaining a rowel spur mark level of grade 2.

Accordingly, the necessary number of rowel spurs is 100÷5=20 in the comparison embodiment, and 100÷11=9.1 in the present, preferred embodiment. The necessary number of rowel spurs is dramatically decreased in the present, preferred embodiment.

As explained above, in the present invention, the teeth of the rowel spur are formed with a plate shape, with each tooth having a substantially constant thickness as viewed in a direction parallel to the central axis of the rowel spur except for in a wedge-shaped end portion of each tooth extending radially inward from the leading edge of each tooth. Each tooth is provided with said wedge-shaped end portion having at least one slanted axial face that intersects a side of said tooth facing in said direction parallel to the central axis of the rowel spur. The slanted axial face extends from the substantially constant thickness portion of the tooth to the leading edge of the tooth, thereby defining the wedge-shaped end portion of the tooth. The remaining thickness $t_2$ of the tooth at the leading edge is 0.04 mm or less (preferably 0.01 mm or less). The amount of visible material such as an ink that adheres to each tooth edge of the rowel spur is minimized and the penetration area of each tooth edge of the rowel spur with respect to the recording medium is narrowed.

Because of the above-discussed wedge-shaped portion of each tooth, the amount of the visible material adhering to the rowel spur can be kept to a minimum even when the amount of ink applied to the recording medium is increased as a result of a requirement to increase the character density, or in the case in which the drying of the visible material such as an ink is delayed. Therefore, retransfer of the ink to the recording medium or smudging of the ink in the portions where the ink is not adhered to the recording medium are eliminated. Therefore, a high quality image can be obtained.

Furthermore, since the penetration of each tooth of the rowel spur into the recording medium can be deepened without increasing the amount of ink retransfered to the recording medium, the ability of the rowel spur to transport the recording medium can be maintained.

While this invention has been described in conjunction with specific embodiments thereof, it is evident that many alternatives, modifications and variations will be apparent to those skilled in the art. Accordingly, the preferred embodiment of the invention set forth herein is intended to be illustrative, not limiting. Various changes may be made without departing from the spirit and scope of the invention as defined in the following claims.

What is claimed is:

1. A recording medium transporting apparatus for transporting a sheet-shaped recording medium, comprising:

a rowel spur having a plurality of teeth and a central axis about which said rowel spur is rotated for transporting the recording medium;

each tooth of said rowel spur having a radially inner portion with substantially constant thickness in an axial direction parallel to said central axis, and a wedge-shaped portion extending radially inward from a radially outermost leading edge of each tooth, said wedge-shaped portion having a slanted face that intersects said axial direction, said slanted face being angled from said radially inner portion of substantially constant thickness to said radially outermost leading edge.

2. The recording medium transporting apparatus according to claim 1, wherein:

said slanted face of said wedge-shaped portion is concavely curved from said axial side of said tooth at said radially inner portion to said leading edge.

3. The recording medium transporting apparatus according to claim 1, wherein:

said slanted face is formed by etching.

4. The recording medium transporting apparatus according to claim 1, wherein:

said teeth are made from an austenitic type stainless steel.

5. The recording medium transporting apparatus according to claim 4, wherein said austenitic type stainless steel is SUS631 having a composition of about 17% Ni, 7% Cr and 1% Al by weight.

6. The recording medium transporting apparatus according to claim 1, wherein:

said radially outermost leading edge has a thickness in said axial direction parallel to said central axis less than or equal to 0.04 mm.

7. The recording medium transporting apparatus according to claim 6, wherein:

said thickness of said leading edge is less than or equal to 0.01 mm.

8. The recording medium transporting apparatus according to claim 1, wherein:

the material from which said teeth are made has a Vickers hardness greater than or equal to 500 VHN.

* * * * *